US007052009B2

(12) United States Patent
Roth

(10) Patent No.: US 7,052,009 B2
(45) Date of Patent: May 30, 2006

(54) SHEET DECELERATION APPARATUS AND METHOD

(75) Inventor: Curtis A. Roth, Post Falls, ID (US)

(73) Assignee: J & L Development, Inc., Keithville, LA (US)

( * ) Notice: Subject to any disclaimer, the term of this patent is extended or adjusted under 35 U.S.C. 154(b) by 203 days.

(21) Appl. No.: 10/681,407

(22) Filed: Oct. 8, 2003

(65) Prior Publication Data

US 2004/0251603 A1 Dec. 16, 2004

Related U.S. Application Data

(60) Provisional application No. 60/472,153, filed on May 21, 2003.

(51) Int. Cl.
*B65H 29/68* (2006.01)

(52) U.S. Cl. ..... 271/182

(58) Field of Classification Search ..... 271/182, 271/273

See application file for complete search history.

(56) References Cited

U.S. PATENT DOCUMENTS 5,904,465 A * 5/1999 Villacieros Fernandez ..... 414/794.5

FOREIGN PATENT DOCUMENTS

DE 3938536 A1 * 6/1990
EP 0150655 A1 * 8/1985

* cited by examiner

*Primary Examiner*—David H. Bollinger
(74) *Attorney, Agent, or Firm*—Dorsey & Whitney LLP

(57) ABSTRACT

An apparatus and method for decelerating a sheet of material for use in a sheet stacking or other application. The apparatus includes a pair of rollers moveable toward and away from one another to nip the sheet traveling between them. The method includes delivering a sheet between a pair of rollers and moving the rollers toward one another to nip, and thus decelerate, the speed of the sheet.

20 Claims, 7 Drawing Sheets

SHEET DECELERATION APPARATUS AND METHOD

RELATED APPLICATION

This application claims the benefit of Provisional Application Ser. No. 60/472,153 filed May 21, 2003.

BACKGROUND OF THE INVENTION

1. Field of the Invention

The present invention relates generally to a sheet deceleration apparatus and method and more specifically to a sheet deceleration apparatus and method for use in controlling the speed of a sheet of corrugated board or other sheet material as it leaves the entry or line conveyor and enters a stacking hopper.

2. Description of the Prior Art

Sheets of corrugated board, paperboard, fiberboard or other sheet material are conventionally conveyed to a stacking hopper on an entry or line conveyor. In some cases, the sheets are overlapped or shingled, while in other cases, gaps in the direction of movement are provided between adjacent sheets. Because many of the sheets have flaps or other protrusions at their leading edges, overlapped or shingled sheets are often not desirable. The sheets are projected off the end of the entry conveyor and over a stacking hopper. The stacking hopper includes a generally vertical backstop and a forwardly positioned back tamper to define a bin or area to receive the sheets in stacked form. The capacity of a particular sheet stacking apparatus is determined by the number of sheets that can be stacked per unit of time. In general, this is directly related to the speed of the entry conveyor. The greater the speed of the entry conveyor, the greater the number of sheets that can be stacked in a unit of time, and thus the greater the stacking capacity of the sheet stacking apparatus. As the speed of the entry conveyor is increased, however, the sheets are projected over the stacking hopper and against the backstop at an increased speed. At elevated speeds beyond a certain speed (usually about 500 feet per minute for certain sheets), the projection against the backstop results in the sheet bouncing back toward the entry conveyor and/or possible damage to protruding tabs or flaps on the leading edge of the sheet. Accordingly, without deceleration means, a sheet stacker has a certain maximum operational speed.

To improve the capacity of the stacker beyond that point, it is necessary to decelerate or slow down the speed of the sheets as they leave the entry conveyor and before they reach the backstop. The prior art includes various deceleration apparatus which function to decelerate or slow down the speed of the sheets in this region. One such prior art machine utilizes a set or pair of spatially fixed rollers at the end of the entry conveyor and prior to the stacking hopper. In this particular apparatus, the nip rollers are positioned on opposite sides of the sheet and are designed to run or be driven at the entry conveyor line speed for most of the length of the sheet. As the trailing edge of the sheet approaches these rollers, they are decelerated to a desired lower speed to slow the sheet. After the sheet has passed, the rollers are accelerated back to line speed before the next sheet arrives. A limitation of this apparatus includes the physical limitations of ramping the rollers up to about 1,000 feet per minute or more and then back down to about 500 feet per minute or less at least three times per second. A further limitation or disadvantage includes machine wear and tear associated with this repeated high speed acceleration and deceleration.

A further deceleration apparatus utilizes an overhead vacuum to transport the sheet into the hopper area. This machine ramps the speed of the vacuum conveyors down to zero, kicks off the end sheet over the hopper, and then ramps back up to line speed. Although this machine is acceptable at lower speeds, it is anticipated that it would have drive problems at higher speeds.

Accordingly, there is a continuing need in the art for a sheet deceleration apparatus and method which overcomes the limitations in the art and provides a deceleration method and apparatus capable of increasing the stacking capacity of a sheet stacker.

SUMMARY OF THE INVENTION

The present invention is directed to a sheet deceleration apparatus and method which has particular application for use in a sheet stacking apparatus for stacking sheets of corrugated board, paperboard, fiberboard or other sheet material from an entry or line conveyor or other delivery means.

In general, in the preferred embodiment, sheets of corrugated board are conveyed along an entry conveyor at line speed toward a stacking hopper. The sheets have a gap in the direction of travel between the trailing edge of one sheet and the leading edge of the adjacent following sheet. Because of their momentum, these sheets are projected over a stacking hopper as they leave the entry conveyor. When the sheet is just short of being completely in the hopper area, a nip roller moves or rotates down and presses the trailing edge of the sheet down for engagement with a deceleration roller which is running at a preset speed lower than that of the line conveyor. When the sheet is nipped or captured between the nip roller and the deceleration roller, the speed of the sheet is reduced to the speed of the deceleration roller. The sheet continues and drops into the stacking hopper at this lower speed. The nip roller then retracts or rises prior to the next sheet entering between the rollers and the process is repeated.

The method aspect of the present invention includes delivering a sheet of material traveling at a line velocity between a pair of rollers, moving the rollers toward one another to nip the sheet and thus reduce its speed to a speed which is less than the line speed.

Accordingly, it is an object of the present invention to provide an improved sheet deceleration apparatus and method.

Another object of the present invention is to provide an apparatus and method for decelerating a sheet of material in combination with a sheet stacker.

A further object of the present invention is to provide a sheet deceleration apparatus and method which utilizes a pair of rollers which are moveable relative to one another to nip or capture a sheet between them to decelerate the sheet.

These and other objects of the present invention will become apparent with reference to the drawings, the description of the preferred embodiment and the appended claims.

DESCRIPTION OF THE PREFERRED EMBODIMENT

The deceleration apparatus and method in accordance with the present invention is designed and intended for use with a sheet stacking machine of the type having an entry conveyor or other sheet delivery means and a stacking hopper. The deceleration apparatus and method and the sheet stacking machine is shown and described with reference to FIGS. 1–7.

Figure 1:
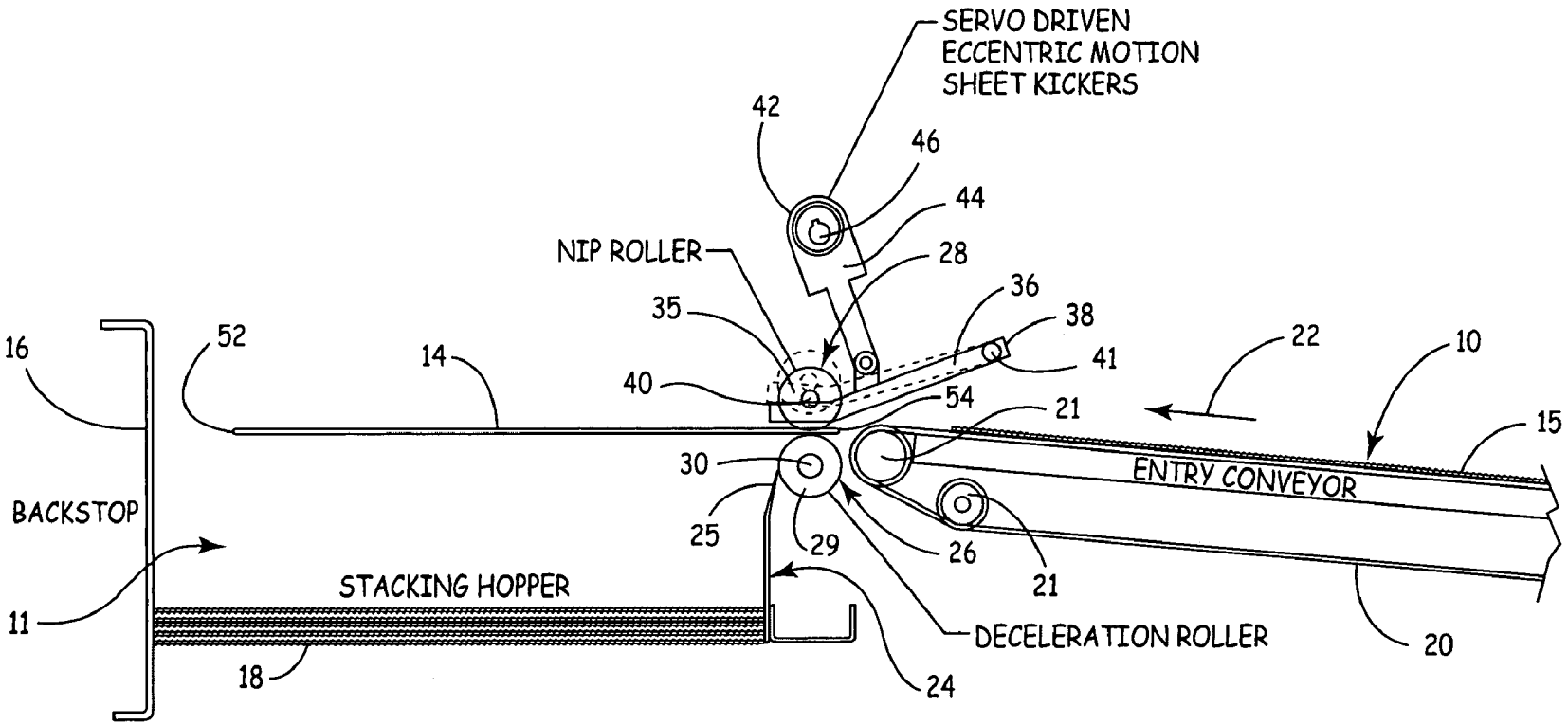
FIG. 1 is an elevational side view of a schematic of the deceleration apparatus of the present invention showing a sheet as it is being decelerated.

With specific reference to FIG. 1, the sheet stacking machine of the preferred embodiment includes an entry conveyor 10 and a stacking hopper 11. During normal operation, a series of sheets 14, 15, etc. are conveyed by the entry conveyor 10 along a travel path toward the stacking hopper 11. As they reach the discharge end of the entry conveyor 10, the sheets 14, 15, etc. are projected toward the backstop 16 of the stacking hopper 11. The projected sheets strike the backstop and fall into the hopper where they accumulate in a stack of sheets 18. The series of sheets 14, 15, etc. are separated in the direction of movement by a gap. With this structure, the sheets delivered by the entry conveyor 10 are formed into stacks 18 of sheets for delivery to a site for further processing or storage.

As shown in FIGS. 2–6, the sheets 14, 15, etc. may be comprised of a pair of sheets 14*a*, 14*b* and 15*a*, 15*b* spaced laterally from one another and being conveyed along the conveyor 10 and through the deceleration mechanism (described below) in a synchronized manner. Each of the sheets 14, 15 (or 14*a*, 14*b*, 15*a*, 15*b*) includes a leading edge 52 and a trailing edge 54. The leading edge 52 is the front or leading edge of the sheets as they travel along the conveyor in the direction of the arrow 22 (FIG. 1), while the trailing edge is the back or trailing edge of the sheets as they travel along the conveyor 10 in the direction of the arrow 22. In FIGS. 1–6, the sheet 14 is a sheet which has been projected from the conveyor 10.

It will be understood that the stacking machine is operable up to a certain maximum entry conveyor speed. If the speed of the entry conveyor 10 exceeds the maximum operational speed, the momentum of the sheets which are projected from the end of the conveyor 10, will carry the sheets against the backstop 16 with excessive force. This can cause the sheets to bounce back toward the conveyor, often resulting in the machine being jammed or the sheets being misaligned or skewed in the stack 18. Projecting the sheets at excessive speeds against the backstop 16 can also result in damage to the leading edge of the sheet. This is particularly the case if the leading edge includes flaps, tabs or other protrusions. Accordingly, the sheet stacking machine has a certain maximum operational entry conveyor speed (normally defined in terms of feet per minute and usually about 500 feet per minute for certain sheets) within which the stacking machine is operational for a sheet of a given size.

To improve the capacity of the sheet stacking machine by increasing the speed of the entry conveyor beyond its normal maximum speed, it is necessary to slow down or decelerate the sheets as they are projected from the entry conveyor to an acceptable speed. This acceptable speed is a speed which will not cause the sheets to bounce back or result in damage to the leading edges of the projected sheets. The deceleration means which is the subject of the present invention and further details of the sheet stacking machine and system are described with reference to FIGS. 1–8.

In the preferred embodiment, the entry conveyor 10 is a belt conveyor. Although the conveyor 10 could comprise a single belt extending across the width of the apparatus, the conveyor 10 of the preferred embodiment is comprised of a plurality of laterally spaced individual belt conveyors or belt conveyor sections 19. These conveyor sections 19 are laterally spaced from one another and include an endless belt 20. Each of the belts 20 is supported by a plurality of belt support rollers 21. At least one of the rollers is driven to provide the roller 10 with its belt or line speed. The belts 20 move in unison to convey the sheets 14, 15, etc. along the conveyor and toward the stacking hopper 11 in the direction indicated by the arrow 22 in FIG. 1. The belts 20 are conventional conveyor belts used in the corrugated, paperboard or other sheet conveyance industry. Although the preferred embodiment shows a sheet stacking machine comprising endless belts as the entry conveyor and as the means for delivering the sheets to the stacking hopper, other means currently known in the art, or which may be made available in the art, to transport or convey sheets may be used as well. Such other means do not alter the advantageous features of the deceleration apparatus and method of the present invention. Such other means may include rollers, overhead or underneath vacuum transport mechanisms or any other similar conveyance or delivery means. Such other means could also comprise top and bottom belts with the sheets sandwiched between them.

It should be noted that the entry conveyor 10, as shown in FIGS. 2–6, is substantially horizontal as it approaches the stacking hopper. While this may be preferred in some situations, the conveyor 10 may be sloped as shown in FIG. 1 in situations where elevation at the front end of the conveyor is needed.

The stacking hopper 11 includes a backstop 16 which is spaced from the forward end of the entry conveyor 10. The distance of this spacing is preferably adjustable to accommodate sheets of different lengths and is preferably at least as great as the length of the sheets (measured in the direction of travel) being stacked. The stacking hopper 11 also includes a back tamper 24 extending generally parallel to the backstop 16. As shown, the back tamper includes a generally vertical wall portion and an upper edge 25 which is sloped toward the entry conveyor 10. This sloping edge 25 assists in guiding the projected sheets into the stacking hopper 11 between the backstop 16 and the back tamper 24. This back tamper is of a conventional design and includes means to square the stack 18 and to repeatedly tamp the rear edges of the sheets in the stack toward the backstop 16 to keep the stack 18 square during the stacking process. Although not shown, the stacking hopper 11 may also be provided with one or more side tampers and a divider if multiple side-by-side sheets are being stacked. In the preferred embodiment, the back tamper is spaced from the entry conveyor 10 a sufficient distance to accommodate the sheet deceleration apparatus of the present invention.

The sheet deceleration apparatus of the present invention includes a first or deceleration roller means or assembly 26 and a second or nip roller means or assembly 28. As shown, the roller means 26 is positioned below or on one side of the sheet travel path, while the roller means 28 is positioned above or on the other side of the sheet travel path. These roller means 26 and 28 are designed for reciprocal movement toward and away from one another to temporarily nip or capture a projected sheet to slow down or decelerate the forward travel speed of that sheet. This permits the entry conveyor 10 to travel at an increased speed, while at the same time preventing the sheets from being projected against the backstop at excessive speeds that would cause the sheets to bounce back or would cause damage to the leading edge of the sheets.

The deceleration roller assembly 26 includes a plurality of deceleration rollers 29 positioned on one side of the projected sheet 14. In the preferred embodiment, the rollers 29 are mounted on a common rotation shaft 30 and are spaced from one another laterally across the width of the entry conveyor 10. The shaft 30, and thus the rotation axis of the rollers 29, is generally perpendicular to the travel path of the sheets. As shown best in FIG. 1, the rollers 29 are positioned at the forward end of the entry conveyor 10. Preferably, the rollers 29 are spaced slightly in front of the forward end of the entry conveyor 10, with the top of the rollers 29 being at or slightly below the conveying level of the conveyor 10. In the preferred embodiment, the top of the rollers 29 are slightly below the conveying level of the conveyor 10 (the sheet travel path). This results in the projected sheet dropping slightly as it is engaged by the nip roller (discussed below) and eliminates or minimizes interference by the leading edge of the following sheet.

The rollers 29 are also preferably positioned slightly rearwardly of the back tamper 24. This permits the projected sheets to fall within the stacking hopper 11 without interference from the rollers 29. The rollers 29 are mounted to the common shaft 30 for rotation with the shaft 30. In the preferred embodiment, the shaft 30, and thus the rollers 29, are driven, although some advantages of the present invention may be achieved with rollers 29 which are free spooled or which are provided with a specified rotational resistance. Preferably, the rollers are driven at a rotational speed such that the circumferential speed of the outer surface of the rollers 29 travels in the same direction as the travel direction 22 of the conveyor 10, but at a reduced speed. The rotational speed of the shaft 30 and rollers 29, and thus the degree of deceleration, may be adjusted so that the circumferential speed of the rollers is about one-half to one-fourth the linear speed of the conveyor 10 or less. However, the degree of deceleration can be any fraction (less than one) of the line speed of the conveyor 10.

As shown best in FIGS. 2–6, the sloping wall section 25 of the back tamper 24 is provided with a plurality of cutout portions or recesses 31 to accommodate nesting of the rollers in those recesses. These recesses 31 are aligned with the rollers 29 and permit the tamping movement of the tamper 24 without interference between the wall 25 and the rollers 29.

Figure 2:
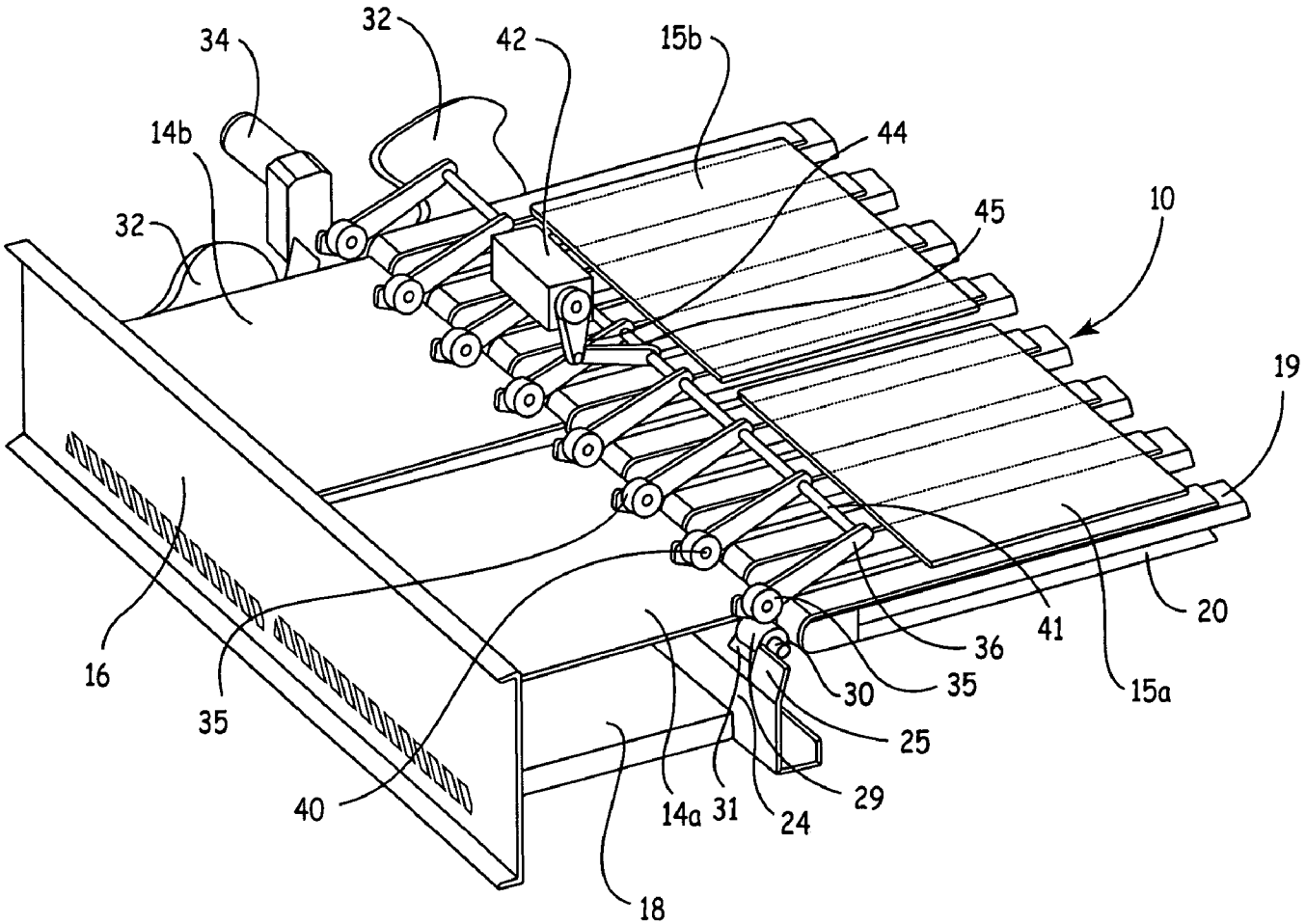
FIG. 2 is an isometric view of the deceleration apparatus of the present invention.
Figure 3:
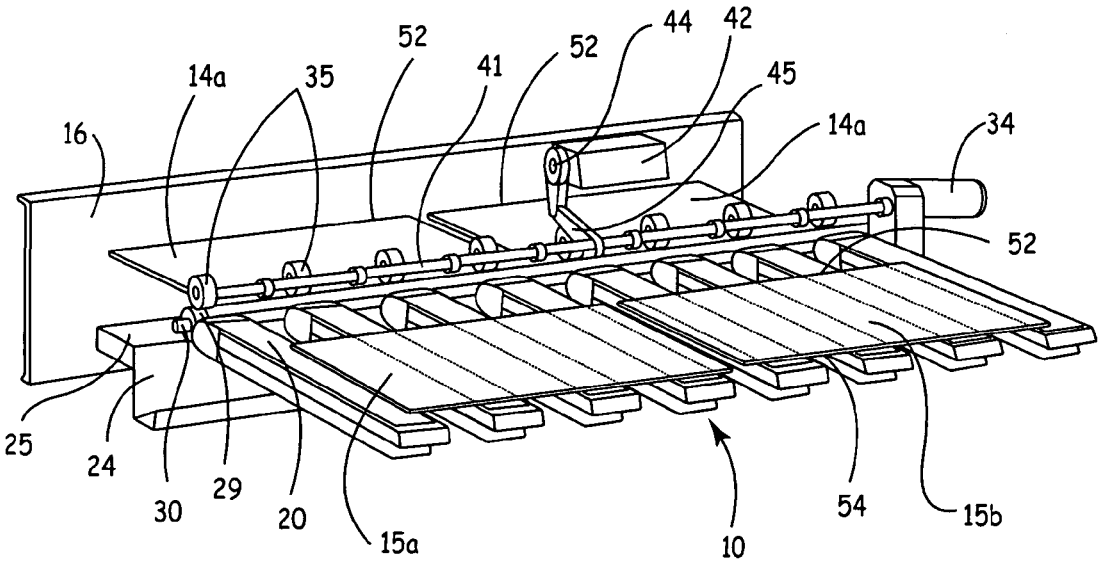
FIG. 3 is a further isometric view of the deceleration apparatus of the present invention.
Figure 4:
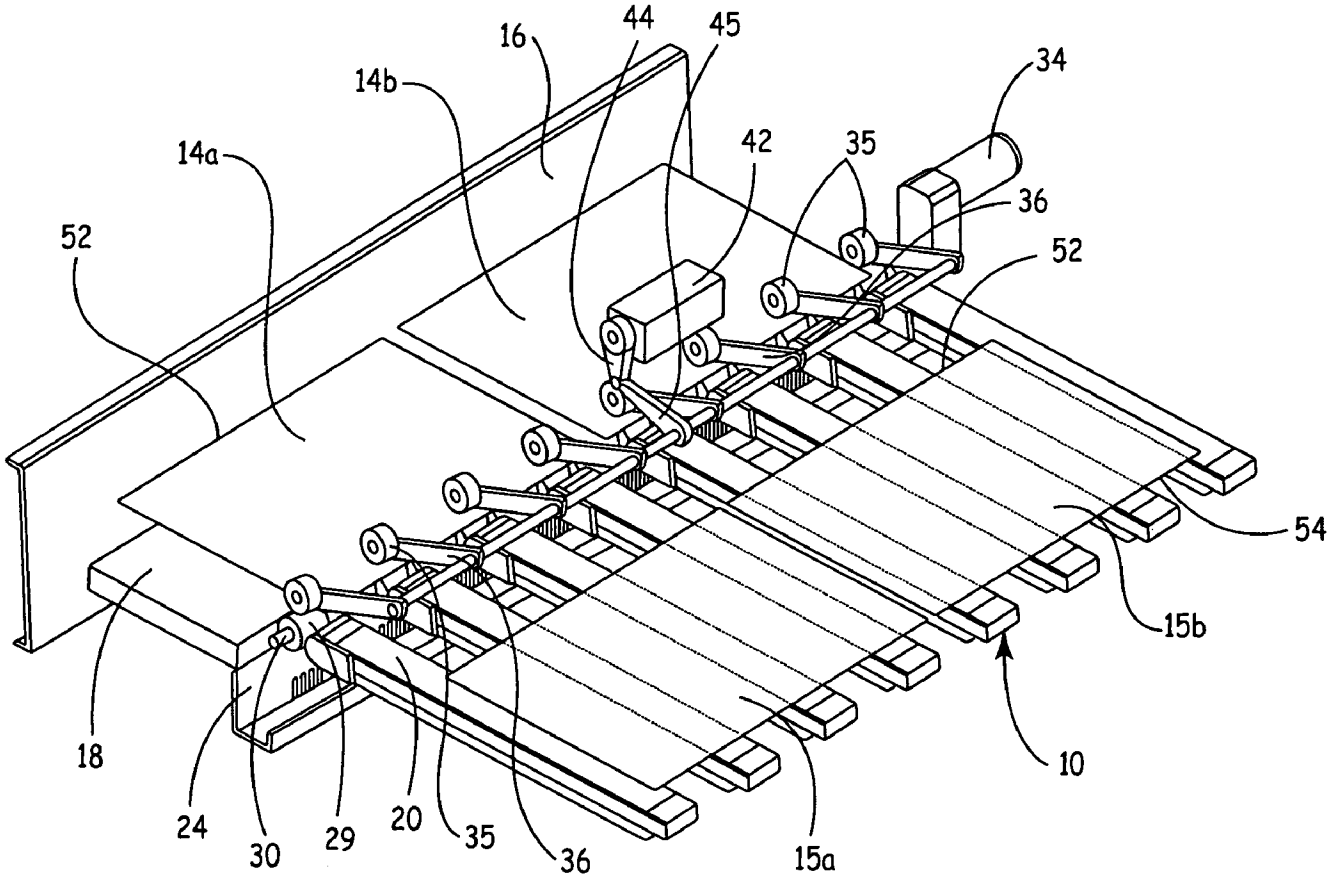
FIG. 4 is a still further isometric view of the deceleration apparatus of the present invention.
Figure 5:
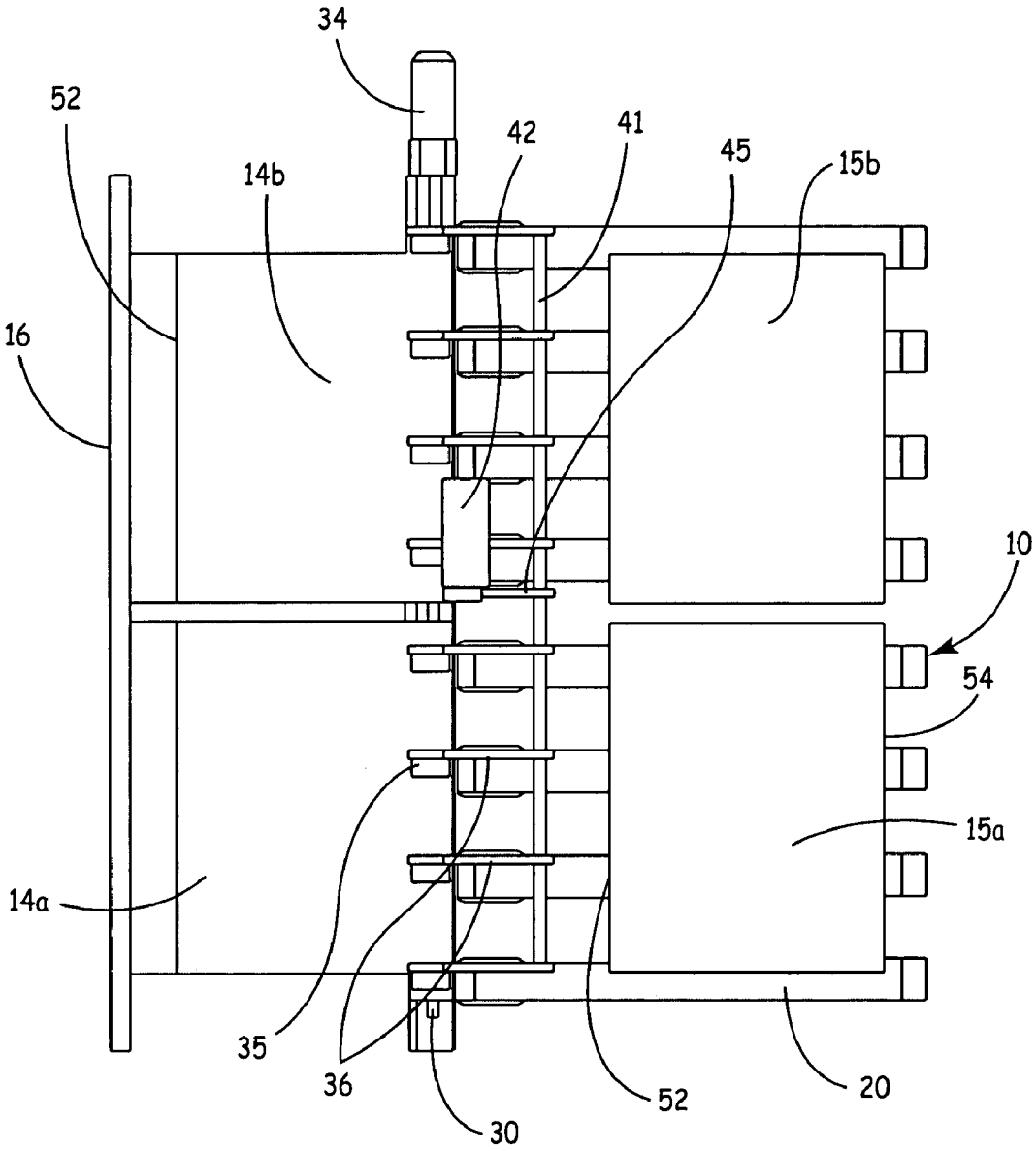
FIG. 5 is an elevational plan view of the deceleration apparatus of the present invention.
Figure 6:
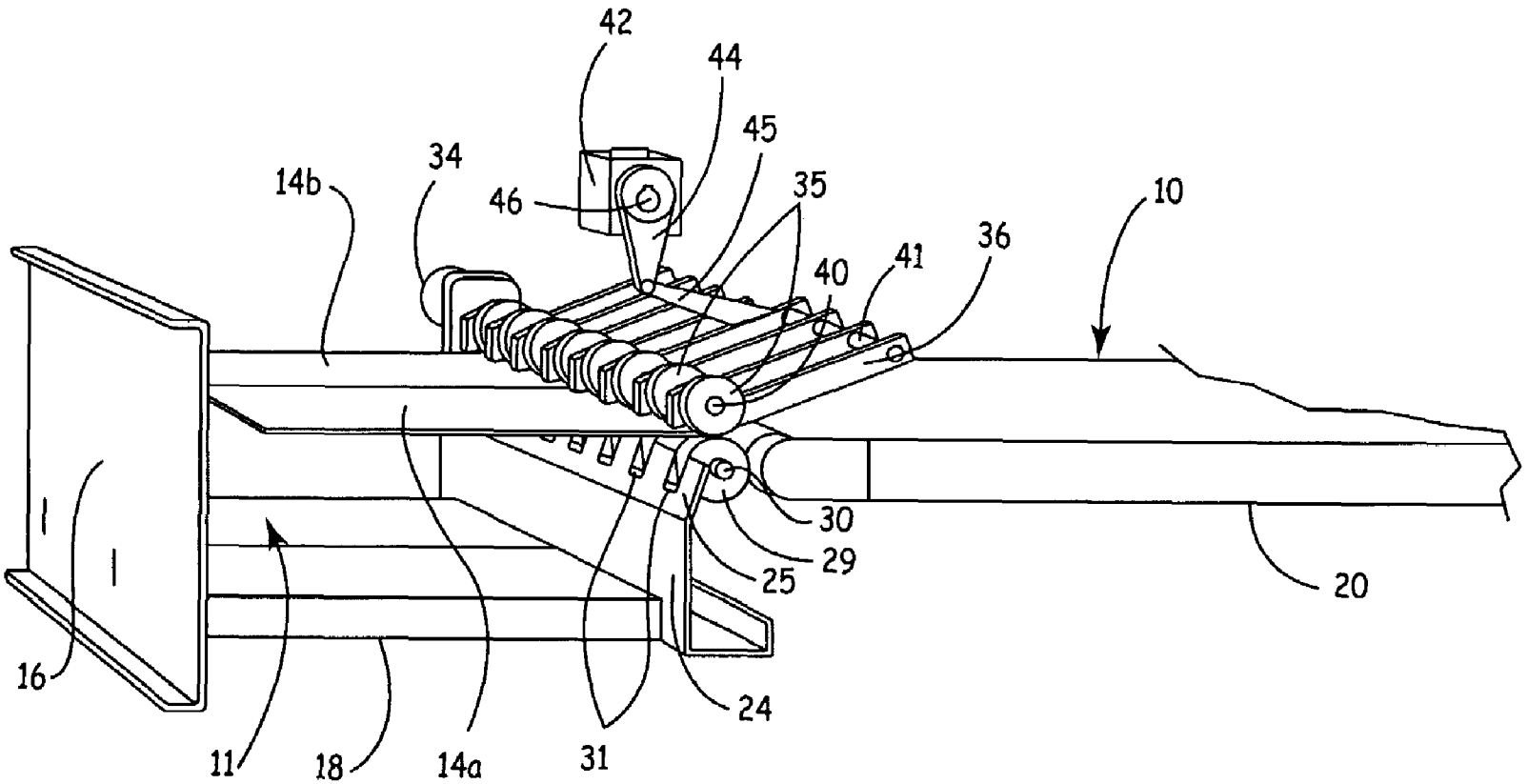
FIG. 6 is a further isometric view of the deceleration apparatus of the present invention.
Figure 7:
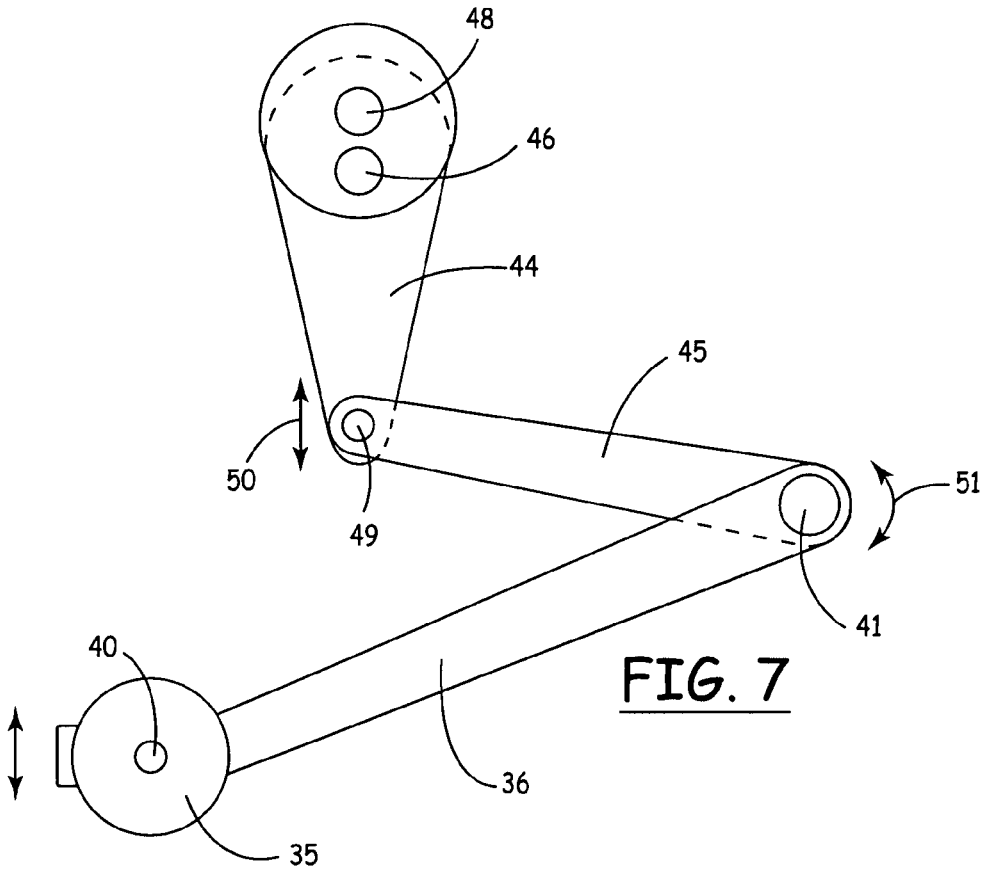
FIG. 7 is an enlarged view of the mechanism for driving the nip rollers.

The shaft 30 and thus the rollers 29 are preferably rotatably supported in a portion of the apparatus of frame 32 (FIG. 2). It is intended that this position of the shaft 30 relative to the apparatus frame 32 be spatially fixed during an operational mode. It is also contemplated, however, that means may be provided, if desired, to adjust the vertical and lateral position of the shaft 30 and thus the rollers 29 relative to the forward end of the entry conveyor 10. The shaft 30 and thus the rollers 29 are driven by a deceleration roller motor 34. In the preferred embodiment, this motor 34 is a variable speed or variable frequency motor designed to run at a plurality of adjustable constant speeds. These speeds are sufficient to rotate the rollers 29 at a circumferential speed (feet per minute) less than the linear speed at which the sheets are traveling on the conveyor 10.

The rollers 29 can be made from a variety of materials. Preferably, these include aluminum or aluminum with a urethane coating. Various plastics and other materials may be used as well.

The nip roller assembly 28 includes a plurality of individual rollers 35. As shown, these rollers 35 are laterally spaced across the width of the entry conveyor 10, with such spacing approximating the spacing of the rollers 29. Accordingly, each of the rollers 29, in the preferred embodiment, includes an associated or complimentary nip roller 35. The rollers 35 are preferably what are known in the art as zero crush rollers. These are rollers which have a circumferential configuration which eliminates or minimizes any damage to the sheet as it is engaged by the rollers 35.

Each of the nip rollers 35 is designed for reciprocal movement toward and away from its associated deceleration roller 29 so as to capture or nip a projected sheet. A variety of structural mechanisms may be designed to provide such relative movement. In the preferred embodiment, this reciprocal movement is provided by a nip roller pivot arm or link 36 associated with each of the rollers 35. Each of these pivot arms 36 includes a rotation end 38 and an opposite free end 39. The nip rollers 35 are rotatably connected near the free ends 39 of the pivot arms 36 about the pivot axis or shaft 40. These pivot arms or shafts 40 are generally perpendicular to the travel path of the sheets. The rotation ends 38 of the pivot arms 36 are rigidly mounted to the pivot shaft 41 in such a manner that pivotal movement of the shaft 41 results in corresponding movement of the pivot arm 36. In the preferred embodiment, the shaft 41 is common to all of the pivot arms 36 and is mounted for limited pivotal movement within a portion of the apparatus frame 32.

The pivot shaft 41 is connected with, and driven by a servo motor 42 through a pair of drive links 44 and 45. As shown more specifically in FIG. 7, the drive link 44 includes a first end which is rotatably connected with an eccentric shaft 46 which is eccentric to the servo motor output shaft 48. The opposite or free end of the drive link 44 is pivotally connected with a free end of the drive link 45 about the pivot 49. The opposite end of the drive link 45 is rigidly secured to the pivot shaft 41 so that movement of the drive link 45 results in corresponding pivotal movement of the pivot shaft 41. Accordingly, as the output shaft 48 of the servo motor 42 rotates, the eccentric shaft 46 revolves around the shaft 48 and provides a reciprocal movement to the pivot 49 joining the links 44 and 45 in the direction of the arrow 50. This results in corresponding reciprocal pivotal movement of the pivot shaft 41 in the direction of the arrow 51. Reciprocal pivotal movement of the shaft 41 results in corresponding pivotal movement of the pivot arms 36, and thus reciprocal movement of the nip rollers 35 toward and away from the deceleration rollers 29.

The servo motor 42 is a conventional servo motor which is synchronized with the speed of the entry conveyor 10, the press and other components of the conveyance and processing system. The function of the synchronized servo motor is to ensure that the reciprocal movement of the nip rollers 35 toward and away from the deceleration rollers 29 engage or nip the projected sheet at the desired point in time (relative to the projected sheet 14) and for the desired length of time to decelerate the sheet from the line speed of the conveyor 10 to a desired lower speed.

Figure 8:
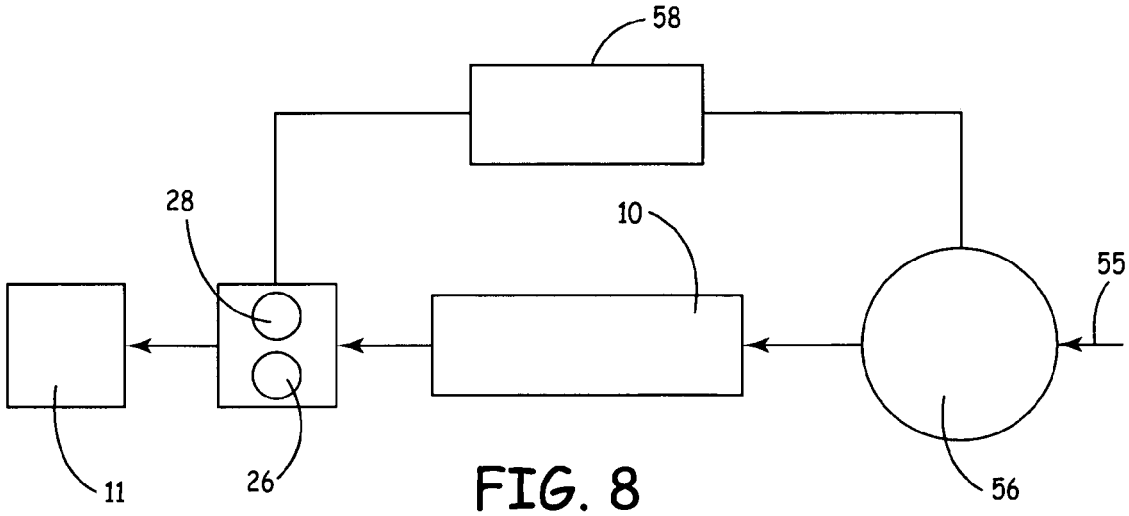
FIG. 8 is a schematic flow diagram showing a sheet formation, delivery, deceleration and stacking system utilizing the present invention.

A system in which the deceleration apparatus and method of the present invention has particular application is illustrated schematically in FIG. 8. In such system, corrugated or other sheets of material are cut from a web 55 of material by a rotary press or drum 56. Depending upon the length of the sheets, one revolution of the drum 56 conventionally may cut out three or six sheets (or more or less for specialty systems). In general, the sheets may be as long as 60 inches or more or as short as 20 inches or less. These sheets are delivered to the entry conveyor 10 described above. The entry conveyor 10 then delivers thee sheets, with gaps between the trailing edge of one sheet and the leading edge of an adjacent following sheet to the deceleration apparatus comprised of the roller assemblies 26 and 28 as described above. The deceleration apparatus reduces the speed of the sheets and delivers the sheets to the hopper 11. In the preferred embodiment, the servo motor 42 which drives the reciprocal movement of the nip roller assembly 28 is synchronized with the conveyor 10 and the press 56 via an encoder associated with the drum 56 and the control 58. Because three, or six, or any other fixed number of sheets may be cut out and transferred to the conveyor 10 during each rotation of the drum 56, the rotation of the servo motor 42 can be timed via an encoder associated with the drum 56 so that the motor 42 will correspondingly rotate three, six or any such other fixed number of times during each rotation of the drum 56. To control the specific time at which rotation of the servo motor 42 is actuated, a phase shift is utilized. Through this phase shift, the specific time at which the output shaft of the servo motor 42 is rotated, and thus the time at which the nip rollers 35 move toward the rollers 29 to engage the projected sheet 14, is controlled. Because the finishing machine or the drum 56 registers the leading edge of each sheet, and because movement of the nip roller 35 and thus actuation of the servo motor 42 is registered with respect to the trailing edge of each sheet, the primary input to the controller 58 is the length of the sheet. From this input, the phase shift can be calculated so that the nip rollers 35 will move toward the rollers 29 and engage the projected sheet 14 shortly before its trailing edge. Preferably, this engagement of the projected sheet by the rollers 35 and 29 occurs as close to the trailing edge of the projected sheet as possible and preferably within an inch or two.

When actuated, the output shaft 48 of the servo motor 42 can be programmed or designed to exhibit a variety of profiles. One such profile is a continuous and relatively constant rotational profile in which the output shaft 48 rotates continuously at a relatively constant speed. A second profile is one in which the shaft 48 is ramped up and then down through 180° to a stop position and after stopping for a predetermined period of time, ramping up and then down through 180° to a further stop position. A third profile is a sinusoidal or other profile in which the rotation of the shaft 48 ramps up to a high speed where the rollers 35 engage and nip the projected sheet against the rollers 29 and then ramp back down to a slow rotational speed as the nip rollers 35 are released. Rotation of the shaft 48 of the servo motor 42 exhibiting a sinusoidal profile is preferred since it appears to provide the smoothest motion.

Having described the structural details of the deceleration apparatus in accordance with the present invention, the operation of that apparatus and the method aspect of the present invention can be understood and is described as follows. During normal operation, a linear series of sheets, 14, 15, etc. travel along the entry conveyor 10 (or are otherwise delivered at line speed) in the direction of the arrow 22. These sheets include a gap between the trailing edge of one sheet and the leading edge of the adjacent following sheet. Because of the speed at which the conveyor 10 is moving, each sheet which reaches the end of the conveyor is projected off the conveyor toward the backstop 16. Shortly before the leading edge of the projected sheet 14 reaches the backstop 16, the nip rollers 35 are moved downwardly toward the deceleration rollers 29 via the servo motor 42 and the drive and pivot link assembly. This movement of the nip rollers 35 toward the deceleration rollers 29 nip or capture the sheet between the rollers. Preferably this movement of the nip rollers 35 toward the deceleration rollers 29 is at a point in time relative to the projected sheet where it nips or captures the projected sheet near its trailing edge or as close to its trailing edge as possible. When the sheet is nipped or captured between the nip and deceleration rollers, the speed of the sheet is reduced to a speed approximating that of the deceleration roller. This is a speed which is less than the line speed of the entry conveyor 10.

After a short period of time, which is dependent primarily on the rotation profile of the servo motor 42, among other factors, the nip roller is moved away from the deceleration roller, thereby allowing the sheet to continue to travel in the forward direction, but at a reduced speed, into the stacking hopper. The extent to which the speed of the sheet is reduced depends on the speed of the entry conveyor 10, the speed of the deceleration rollers 29 and the size of the sheets, among other factors.

Although the preferred embodiment contemplates a servo motor 42 which is synchronized with the speed of the conveyor 10 and the rotation of the drum 56 as described above, photodetectors or other position detecting means can be utilized to identify or detect the particular position or location of an advancing sheet and trigger the actuation of the servo motor 42 at the desired point in time.

Also, although the preferred embodiment shows the deceleration rollers 29 as being spatially fixed relative to the apparatus frame 32, with the nip rollers 35 moving in reciprocal relationship toward and away from the deceleration rollers 29, the reverse could be provided without deviating from the spirit of the present invention. For example, the nip rollers 35 could be spatially fixed relative to the apparatus frame 32 and the deceleration rollers could be reciprocally moved toward and away from the nip rollers. It is also possible and contemplated by the present invention that both the nip rollers 35, as well as the deceleration rollers 29 could be moved toward one another relative to the apparatus frame 32.

The preferred embodiment also discloses the nip rollers 35 as not being driven. The present invention contemplates that the nip rollers 35 could, like the deceleration rollers 29, be driven. Preferably, however, the nip rollers 35 are not driven and are permitted to free spool and thus assume the speed of the sheet as the nip and deceleration rollers nip or capture the moving sheet.

Although the modified embodiments have been specifically described, it is contemplated that various additional modifications could be made without deviating from the spirit of the present invention. Accordingly, it is intended that the scope of the present invention be dictated by the appended claims rather than by the description of the preferred embodiment.

The invention claimed is:

1. A sheet deceleration apparatus for reducing the speed of a sheet of material moving along a travel path at a first speed, said apparatus comprising:

a first rotatable roller being rotatable about a first axis, said first axis being substantially perpendicular to the travel path and said first roller being positioned on one side of the travel path;

a second rotatable roller being rotatable about a second axis, said second axis being substantially perpendicular to the travel path and said second roller being positioned on the other side of the travel path and spaced from said first roller so that the sheet of material can pass between said first and second rollers wherein one of said first and second rollers is driven and the other of said first and second rollers is not driven;

at least one of said first and second rollers being moveable relative to and toward the other of said first and second rollers to nip the sheet between said first and second rollers during at least a portion of the travel of the sheet past said first and second rollers wherein said at least one roller is moveable between a retracted position in which said at least one roller is sufficiently spaced from the other roller so as to not nip the sheet of material and an extended position in which said at least one roller is moved toward the other roller a distance sufficient to nip the sheet of material; and a drive mechanism comprising a servo drive for moving said at least one roller from said retracted position to said extended position and for moving said at least one roller from said extended position to said retracted position.

2. The apparatus of claim 1 wherein said other roller is moveable toward said one roller.

3. The apparatus of claim 1 wherein said at least one rollers is reciprocally moveable toward and away from the other rollers.

4. The apparatus of claim 1 wherein said servo drive includes a servo motor and a drive linkage assembly between said servo motor and said at least one roller.

5. The apparatus of claim 1 wherein the driven roller comprises a plurality of first laterally spaced driven rollers and the non-driven roller comprises a plurality of second laterally spaced non-driven rollers.

6. The apparatus of claim 1 wherein said at least one roller is the non-driven roller and comprises a plurality of laterally spaced non-driven rollers each rotatable about a first rotation axis and wherein said drive linkage includes a pivot shaft pivotable about a pivot axis, said pivot axis being parallel to said first rotation axis and said first rotation axis and said plurality of spaced non-driven rollers being pivotable about said pivot axis between said retracted and said extended positions.

7. The apparatus of claim 6 wherein the driven roller comprises a plurality of laterally spaced driven rollers.

8. A combination sheet stacking and deceleration apparatus comprising:

an entry conveyor for delivering sheets of material along a travel path toward a discharge end of said conveyor;

a stacking hopper positioned downstream from the discharge end of said entry conveyor; and a sheet deceleration apparatus positioned between the discharge end of said entry conveyor and said stacking hopper, said sheet deceleration apparatus including a driven roller assembly comprised of a plurality of laterally spaced driven rollers positioned below the travel path and a non-driven roller assembly comprised of a plurality of laterally spaced non-driven rollers positioned above the travel path, said driven rollers being mounted on a driven shaft and said non-driven rollers being moveable toward and away from corresponding ones of said driven rollers between a retracted position in which said at one roller is sufficiently spaced from the other roller so as to not nip the sheet of material and an extended position in which said at least one roller is moved toward the other roller a distance sufficient to nip the sheet of material.

9. The apparatus of claim 8 wherein said entry conveyor is a belt conveyor.

10. The apparatus of claim 8 wherein said entry conveyor delivers said sheets at a line speed and wherein said driven rollers are driven at a speed less than said line speed.

11. The apparatus of claim 8 including a drive mechanism comprising a servo motor and a drive linkage between said servo motor and said non-driven roller assembly.

12. The apparatus of claim 8 wherein said non-driven rollers are spaced from and connected with a common pivot shaft.

13. The apparatus of claim 12 including a servo drive to rotate said pivot shaft to move said non-driven rollers between said retracted and extended positions.

14. A method for decelerating a sheet of material traveling along a travel path at a line speed, said method comprising:

delivering said sheet of material between a driven roller and a non-driven roller, said driven and non-driven rollers being rotatable on first and second axes, respectively, said first and second axes being substantially perpendicular to said travel path and parallel to one another; and driving at least one of said driven and non-driven rollers toward the other with a servo drive to nip said sheet of material during at least a portion of the sheet travel between said rollers, said servo drive comprised of a servo motor and a drive linkage positioned between said servo motor and said at least one roller.

15. The method of claim 14 including driving said driven roller at a speed less than said line speed.

16. The method of claim 14 including delivering a series of sheets of material along said travel path at a line speed wherein each of said sheets includes a leading edge and a trailing edge and wherein said series of sheets are spaced from adjacent sheets in the travel path to define a gap between the trailing edge of one sheet and the leading edge of an adjacent following sheet.

17. The method of claim 16 including driving said at least one roller away from said other roller with said servo drive after nipping said sheet of material to permit delivery of the adjacent following sheet between said driven and non-driven rollers and further including synchronizing the delivery of said series of sheets and the driving of said at least one roller so said at least one roller moves toward said other roller and away from said other roller during the travel of each sheet between said driven and non-driven rollers.

18. The method of claim 17 including forming said sheets of material on a rotary press prior to said delivering step.

19. The method of claim 18 wherein said synchronizing step includes controlling the actuation of said servo drive in response to the rotation of said rotary press.

20. The method of claim 14 including controlling the driving of at least one of said driven and non-driven rollers by controlling the rotational profile of said servo drive.

* * * * *